US005600970A

United States Patent [19]

Drnevich et al.

[11] Patent Number: 5,600,970

[45] Date of Patent: Feb. 11, 1997

[54] CRYOGENIC RECTIFICATION SYSTEM WITH NITROGEN TURBOEXPANDER HEAT PUMP

[75] Inventors: Raymond F. Drnevich, Clarence Center; Neil M. Prosser, Lockport, both of N.Y.

[73] Assignee: Praxair Technology, Inc., Danbury, Conn.

[21] Appl. No.: 574,665

[22] Filed: Dec. 19, 1995

[51] Int. Cl.[6] ..... F25B 3/00

[52] U.S. Cl. ..... 62/651; 62/654

[58] Field of Search ..... 62/650, 651, 654

[56] References Cited

U.S. PATENT DOCUMENTS

| | | | |
|---|---|---|---|
| 4,224,045 | 9/1980 | Olszewski et al. | 62/30 |
| 4,345,925 | 8/1982 | Cheung | 62/13 |
| 4,702,757 | 10/1987 | Kleinberg | 62/24 |
| 4,704,148 | 11/1987 | Kleinberg | 62/24 |
| 5,074,898 | 12/1991 | Cheung | 62/38 |
| 5,222,365 | 6/1993 | Nenov | 62/651 |
| 5,228,298 | 7/1993 | Kun et al. | 62/651 |
| 5,337,571 | 8/1994 | Ducrocq | 62/651 |
| 5,341,647 | 8/1994 | Koeberle | 62/650 |
| 5,379,598 | 1/1995 | Mostello | 62/24 |
| 5,379,599 | 1/1995 | Mostello | 62/25 |
| 5,392,609 | 2/1995 | Girault et al. | 62/25 |
| 5,406,786 | 4/1995 | Scharpf et al. | 62/39.05 |

OTHER PUBLICATIONS

Springmann, The Production Of High–Pressure Oxygen, Linde, vol. 46, pp. 3–7, 1979.

*Primary Examiner*—Ronald C. Capossela
*Attorney, Agent, or Firm*—Stanley Ktorides

[57] ABSTRACT

A cryogenic rectification system which can operate at elevated pressure without encountering a severe separation efficiency burden wherein additional column reflux is generated by an indigenous nitrogen heat pump circuit.

11 Claims, 3 Drawing Sheets

CRYOGENIC RECTIFICATION SYSTEM WITH NITROGEN TURBOEXPANDER HEAT PUMP

TECHNICAL FIELD

This invention relates generally to cryogenic rectification and more particularly to cryogenic rectification systems wherein the columns are operated at higher than normal pressures.

BACKGROUND ART

Certain industrial gas applications, such as coal gasification combined cycle systems, often require nearly all of the product from a cryogenic air separation plant, e.g. oxygen and nitrogen, to be at an elevated pressure. One way to achieve this is to compress the product streams taken from the air separation plant. However, such product compression is costly and involves the use of additional compression equipment.

A preferred mode of operation to achieve high pressure product production is to operate the columns of the air separation plant at higher pressures, thus producing the products at higher pressures and reducing or even eliminating entirely the need for final product compression. However, operating the columns of a cryogenic air separation plant at elevated pressures imposes an operating burden on the plant because the separation efficiency is a function of the difference in volatilities of the components of the feed air and such volatility differences are reduced as the pressure increases.

Accordingly, it is an object of this invention to provide a method for operating a cryogenic rectification plant at higher than normal pressures while mitigating the separation burden on the system resulting from such high pressure operation.

In addition, the pumping of liquid oxygen to a higher pressure when the system is operated at high pressures generally leads to especially poor recovery of product oxygen. It is therefore another object of this invention to employ pumping of liquid oxygen in order to minimize the cost of oxygen compression while maintaining acceptable oxygen recovery in a high pressure plant.

SUMMARY OF THE INVENTION

The above and other objects, which will become apparent to one skilled in the art upon a reading of this disclosure, are obtained by the present invention which is:

A method for operating a cryogenic rectification plant comprising:

(A) providing feed air at a pressure greater than 100 psia into a cryogenic rectification plant and separating the feed air by cryogenic rectification within the cryogenic rectification plant into oxygen-richer and nitrogen-richer fluids;

(B) withdrawing nitrogen-richer fluid from the cryogenic rectification plant and warming the withdrawn nitrogen-richer fluid;

(C) withdrawing oxygen-richer fluid from the cryogenic rectification plant as liquid and pumping the withdrawn oxygen-richer liquid to a higher pressure;

(D) compressing the warmed nitrogen-richer fluid and thereafter cooling the compressed nitrogen-richer fluid by indirect heat exchange with the pumped oxygen-richer liquid;

(E) turboexpanding the cooled nitrogen richer fluid; and (F) passing the turboexpanded nitrogen-richer fluid into the cryogenic rectification plant.

As used herein, the terms "turboexpansion" and "turboexpander" mean respectively method and apparatus for the flow of high pressure fluid through a turbine to reduce the pressure and the temperature of the fluid thereby generating refrigeration.

As used herein, the term "column" means a distillation or fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluid streams into heat exchange relation without any physical contact or intermixing of the fluids with each other.

As used herein the term "cryogenic rectification plant" means the columns wherein feed air is separated by cryogenic rectification, as well as interconnecting piping, valves, heat exchangers and the like.

As used herein the terms "upper portion" and "lower portion" of a column mean those portions respectively above and below the midpoint of the column.

As used herein the term "oxygen-richer fluid" means a fluid having an oxygen concentration equal to or greater than 50 mole percent.

As used herein the term "nitrogen-richer fluid" means a fluid having a nitrogen concentration equal to or greater than 80 mole percent.

As used herein, the term "feed air" means a mixture comprising primarily nitrogen and oxygen such as ambient air.

DETAILED DESCRIPTION

In general the invention comprises a heat pump circuit wherein heat within a stream taken from a cryogenic rectification plant is pumped from a lower temperature to a higher temperature. This results in the creation of additional liquid for the plant enabling the plant to operate with improved separation efficiency despite operating at higher than conventional pressures.

Figure 1:
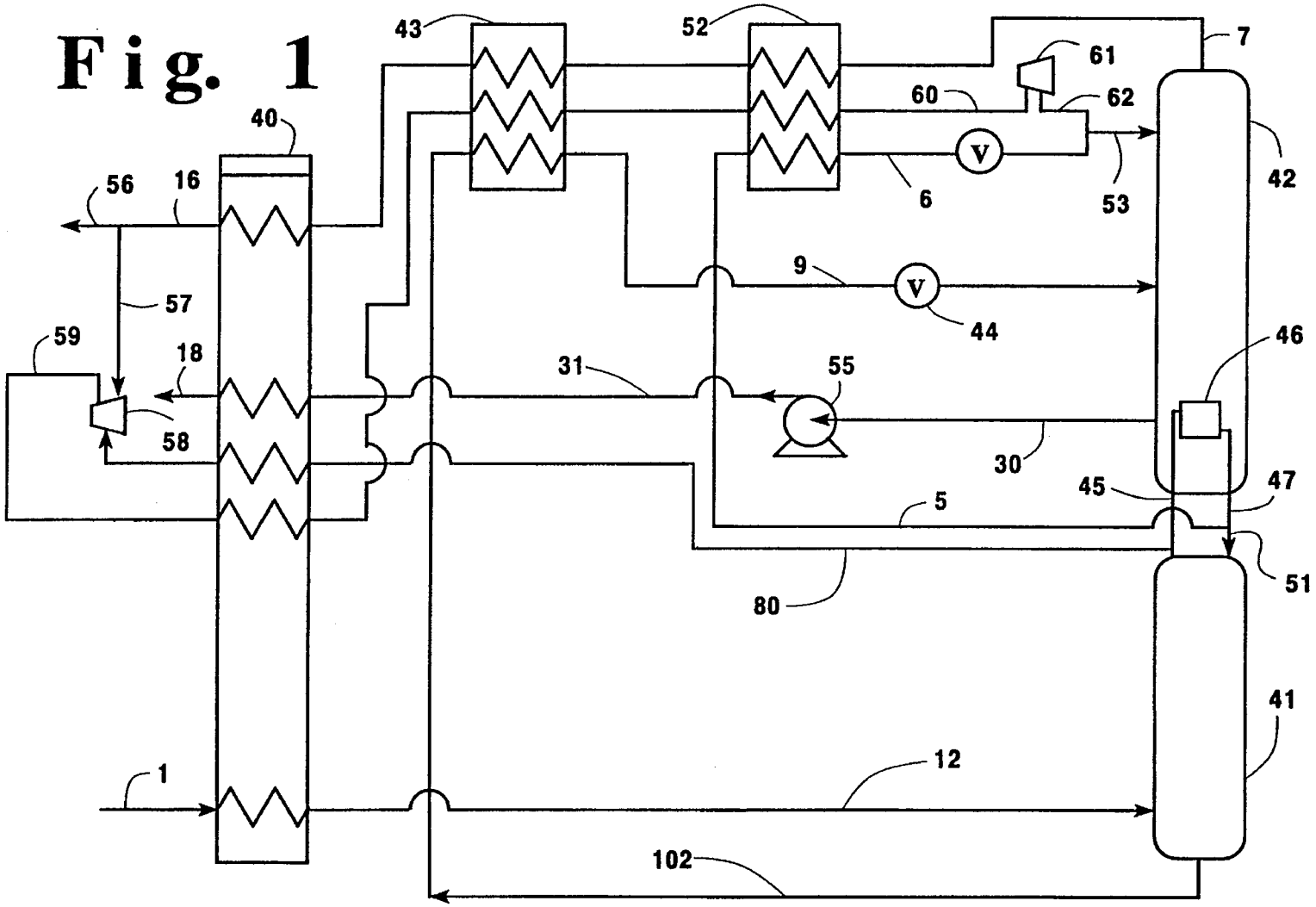
FIG. 1 is a schematic representation of a particularly preferred embodiment of the invention wherein the nitrogen-richer fluid is taken from the lower pressure column and turboexpanded back into the lower pressure column.

The invention will be described in greater detail with reference to the drawings. Referring now to FIG. 1, feed air 1, which has been cleaned of high boiling impurities such as carbon dioxide and vapor, and is at an elevated pressure greater than 100 pounds per square inch absolute (psia), preferably within the range of from 150 to 350 psia, is cooled by passage through main heat exchanger 40. Resulting stream 12 is passed into column 41 which is operating at a pressure within the range of from 100 to 350 psia and is the higher pressure column of a double column cryogenic rectification plant which also includes lower pressure column 42.

Within higher pressure column 41 the feed air is separated by cryogenic rectification into nitrogen-enriched vapor and oxygen-enriched liquid. Oxygen-enriched liquid is withdrawn from higher pressure column 41 as stream 102 and subcooled by passage through subcooler 43. Resulting subcooled stream 9 is passed through valve 44 and into lower pressure column 42 which is operating at a pressure less than that of higher pressure column 41 and within the range of from 45 to 200 psia. Nitrogen-enriched vapor is withdrawn from higher pressure column 41 as stream 45 and at least partially condensed in main condenser 46 by indirect heat exchange with boiling column 42 bottom liquid. Nitrogen vapor having a nitrogen concentration of at least 95 mole percent may be withdrawn from higher pressure column 41, warmed in heat exchanger 40 and recovered as product. Optionally, a portion of such high pressure nitrogen stream can be added to compressor unit 58 at an interstage level as illustrated by stream 80. Stream 47 is passed out from main condenser 46, a first portion 51 of this nitrogen-enriched liquid is returned to higher pressure column 41 as reflux, and a second portion 5 of the nitrogen-enriched liquid is cooled in heat exchanger 52 and resulting stream 6 is expanded and passed into lower pressure column 42 as reflux. In the embodiment illustrated in FIG. 1, nitrogen-enriched liquid 6 is combined with the nitrogen heat pump fluid, as will be more fully described below, and the combined stream 53 is passed into column 42. These streams can also be passed separately into column 42.

Within lower pressure column 42 the various feeds are separated by cryogenic rectification into nitrogen top vapor, having a nitrogen concentration of at least 97 mole percent, and oxygen bottom liquid, having an oxygen concentration of at least 60 mole percent. Oxygen bottom liquid is partially vaporized by the aforedescribed heat exchange with nitrogen-enriched vapor 45 in main condenser 46, and the resulting vapor is used for column 42 upflow. Remaining oxygen bottom liquid, or oxygen-richer fluid, is passed as stream 30 to liquid pump 55 wherein it is pumped to a higher pressure, generally within the range of from 400 to 1400 psia. Resulting stream 31 is then warmed and vaporized by passage through main heat exchanger 40 and recovered as product high pressure oxygen stream 18.

In the embodiment illustrated in FIG. 1, nitrogen top vapor is used as the nitrogen-richer fluid for the heat pump of this invention. Nitrogen top vapor is withdrawn from lower pressure column 42 as stream 7 and warmed by passage through heat exchangers 52, 43 and 40. Warmed nitrogen-richer vapor 16 is divided into first portion 56 which is removed from the system and into second portion 57 which continues as the heat pump fluid. Portion 57 is compressed by passage through compressor 58 to a pressure within the range of from 400 to 1400 psia. Optionally, some nitrogen top vapor may be withdrawn from higher pressure column 41 warmed by passage through heat exchanger 40 and combined with stream 57 at an intermediate pressure in compressor 58. Resulting compressed nitrogen-richer vapor 59 is cooled by passage through heat exchangers 40, 43 and 52. The embodiment illustrated in FIG. 1 is a preferred embodiment wherein the cooling of the compressed nitrogen-richer fluid is carried out by indirect heat exchange with the warming nitrogen- richer fluid along with the pumped oxygen-richer liquid.

The cooled nitrogen-richer fluid 60 is turboexpanded in turboexpander 61 to generate refrigeration and resulting turboexpanded stream 62 is passed into lower pressure column 42. Preferably the turboexpansion of stream 60 through turboexpander 61 results in the generation of liquid for passage back into the cryogenic rectification plant. As discussed above, preferably stream 62 is mixed with stream 6 to produce mixed stream 53 which is then passed into lower pressure column 42. Stream 62 and stream 6 can also be passed separately into column 42.

Figure 2:
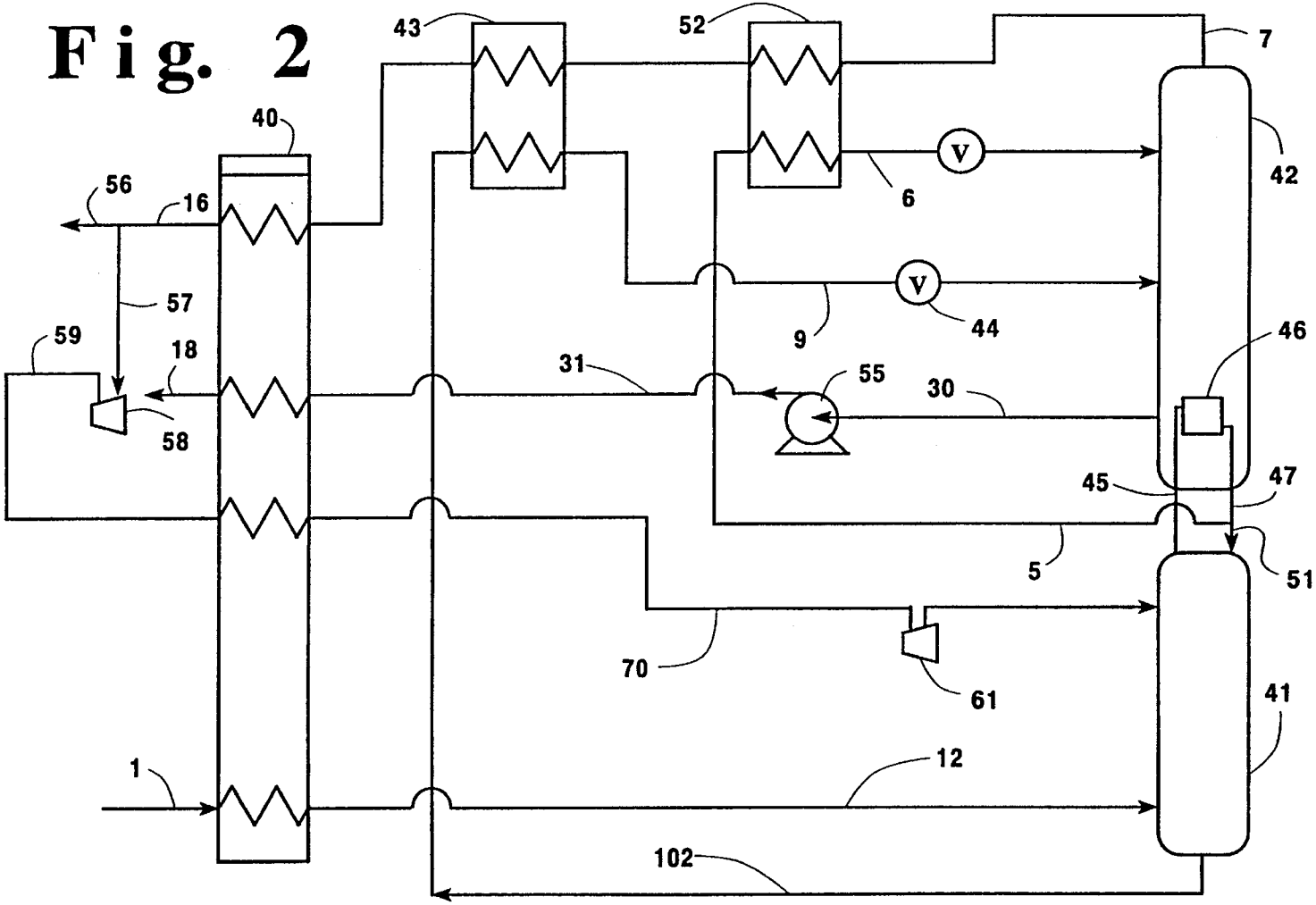
FIG. 2 is a schematic representation of another preferred embodiment of the invention wherein the nitrogen-richer fluid is taken from the lower pressure column and turboexpanded into the higher pressure column.

FIG. 2 illustrates another embodiment of the invention wherein the turboexpanded nitrogen-richer heat pump fluid is passed into the higher pressure column of the cryogenic rectification plant. The numerals of FIG. 2 correspond to those of FIG. 1 for the common elements and these common elements will not be described again in detail.

Referring now to FIG. 2, compressed nitrogen-richer fluid 59 is cooled by passage through main heat exchanger 40 to produce cooled nitrogen-richer fluid 70. In the embodiment illustrated in FIG. 2 the cooled nitrogen-richer heat pump fluid, after passage through main heat exchanger 40, is not passed through heat exchangers 43 and 52 but, rather, is passed directly to turboexpander 61 wherein it is turboexpanded to generate refrigeration. Resulting turboexpanded stream 62, which is preferably liquid, is then passed into higher pressure column 41.

Figure 3:
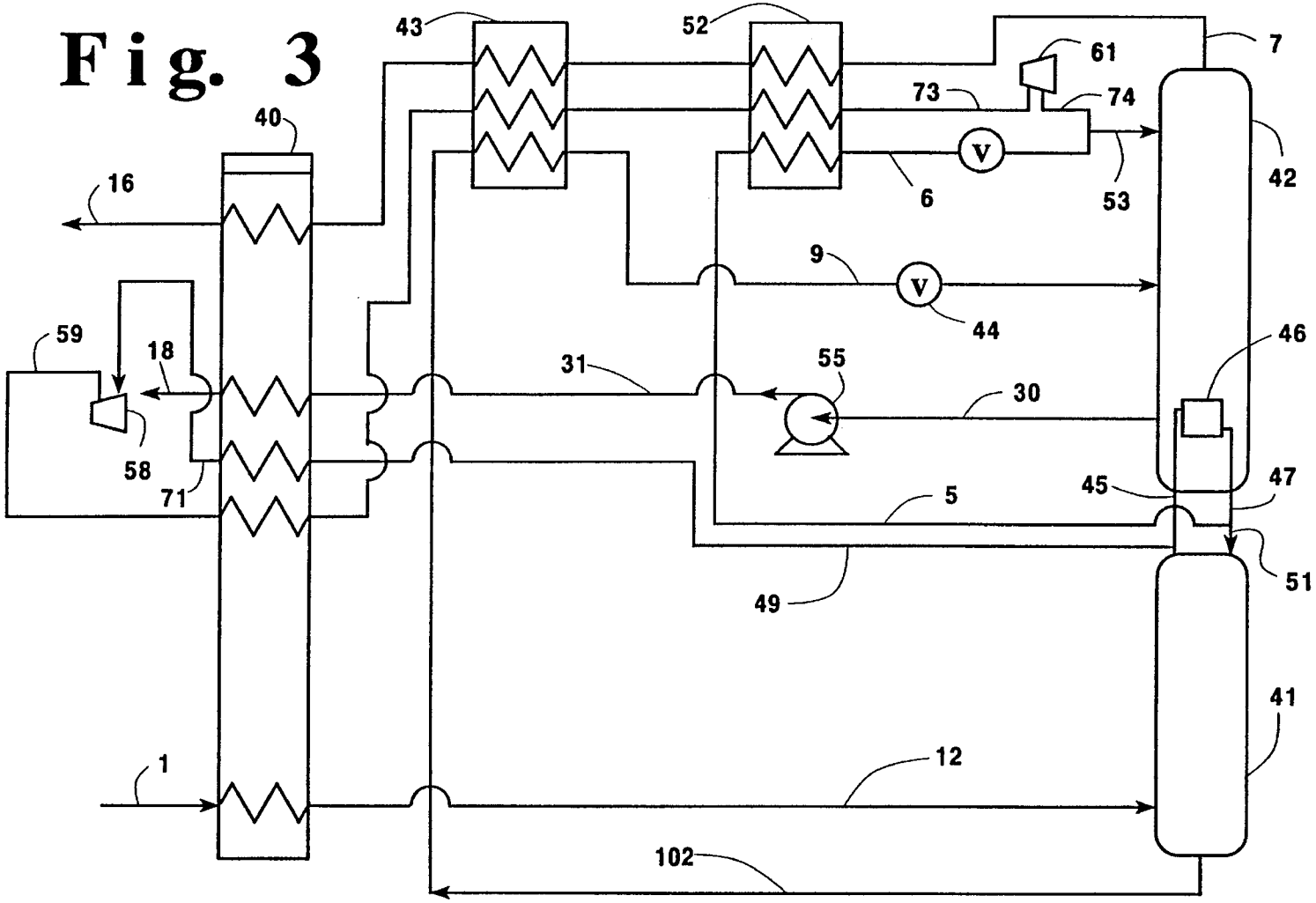
FIG. 3 is a schematic representation of another preferred embodiment of the invention wherein the nitrogen-richer fluid is taken from the higher pressure column and turboexpanded into the lower pressure column.

FIG. 3 illustrates another embodiment of the invention wherein the nitrogen-richer heat pump fluid is taken from the higher pressure column and the turboexpanded heat pump fluid is passed into the lower pressure column. The numerals of FIG. 3 correspond to those of FIGS. 1 and 2 for the common elements and these common elements will not be described again in detail.

Referring now to FIG. 3, nitrogen top vapor withdrawn from column 42 as stream 7 is passed through heat exchangers 52, 43 and 40 wherein it is warmed and resulting stream 16 is removed from the system. Stream 16 may be recovered, in whole or in part, as product nitrogen gas. In the embodiment illustrated in FIG. 3, high pressure nitrogen stream 49 is used as the nitrogen-richer fluid for the heat pump of this invention. Stream 49 is warmed by passage through main heat exchanger 40. Resulting warmed stream 71 is compressed by passage through compressor 58 to a pressure within the range of from 400 to 1400 psia and resulting compressed stream is cooled by passage through main heat exchanger 40 and heat exchangers 43 and 52. Cooled nitrogen-richer heat pump fluid 73 is turboexpanded through turboexpander 61 to generate refrigeration and resulting turboexpanded stream 74, which is preferably a liquid stream, is then passed into lower pressure column 42, preferably, as illustrated in FIG. 3, in combination with stream 6.

Now by the use of this invention, one may operate a cryogenic rectification plant at higher pressures so as to reduce or eliminate the need for additional product stream compression using a liquid pump to provide some or all of the pressure elevation for the product oxygen stream, without encountering the severe burden on separation efficiency within the columns normally attendant to such high pressure operation. The invention accomplishes this by employing nitrogen produced in the plant as a heat pump fluid and uses this fluid to pump heat from a lower to a higher temperature. This serves to generate additional reflux for the columns which helps the columns carry out the cryogenic separation despite the higher operating pressures. The turboexpansion provides two primary advantages. It generates more refrigeration which, in many instances, will provide sufficient refrigeration to eliminate the need for a gas phase expander. In addition it reduces or eliminates the flashoff of the liquid feed to the column that comes from the turbine resulting in improved oxygen recovery by virtue of the greater reflux for the distillation. The stream to be turboexpanded is generally a supercritical fluid. If it were at a lower pressure it would be a liquid. Preferably the output from the turbine is all liquid, even subcooled, as this improves oxygen recovery, although there may be times when the turbine exhaust has a small fraction of vapor.

Although the invention has been described in detail with reference to certain preferred embodiments, those skilled in the art will recognize that there are other embodiments of the invention within the spirit and the scope of the claims. For example the invention may be practiced in conjunction with an argon sidearm column wherein argon product is produced, or with a side column for the production of lower purity oxygen.

We claim:

1. A method for operating a cryogenic rectification plant comprising:

(A) providing feed air at a pressure greater than 100 psia into a cryogenic rectification plant and separating the feed air by cryogenic rectification within the cryogenic rectification plant into oxygen-richer and nitrogen-richer fluids;

(B) withdrawing nitrogen-richer fluid from the cryogenic rectification plant and warming the withdrawn nitrogen-richer fluid;

(C) withdrawing oxygen-richer fluid from the cryogenic rectification plant as liquid and pumping the withdrawn oxygen-richer liquid to a higher pressure;

(D) compressing the warmed nitrogen-richer fluid and thereafter cooling the compressed nitrogen-richer fluid by indirect heat exchange with the pumped oxygen-richer liquid;

(E) turboexpanding the cooled nitrogen richer fluid; and (F) passing the turboexpanded nitrogen-richer fluid into the cryogenic rectification plant.

2. The method of claim 1 wherein the nitrogen-richer fluid withdrawn from the cryogenic rectification plant is warmed by indirect heat exchange with the cooling compressed nitrogen-richer fluid.

3. The method of claim 1 wherein the cryogenic rectification plant comprises a double column having a higher pressure column and a lower pressure column.

4. The method of claim 3 wherein the nitrogen-richer fluid is withdrawn from the lower pressure column.

5. The method of claim 3 wherein the nitrogen-richer fluid is withdrawn from the higher pressure column.

6. The method of claim 3 wherein the nitrogen-richer fluid is withdrawn from both the lower pressure column and the higher pressure column.

7. The method of claim 3 wherein the turboexpanded nitrogen-richer fluid is passed into the lower pressure column.

8. The method of claim 3 wherein the turboexpanded nitrogen-richer fluid is passed into the higher pressure column.

9. The method of claim 1 wherein the turboexpanded nitrogen-richer fluid is a liquid.

10. The method of claim 1 further comprising recovering oxygen-richer fluid as product oxygen.

11. The method of claim 1 further comprising recovering nitrogen-richer fluid as product nitrogen.

* * * * *